United States Patent [19]

Katahira et al.

[11] 4,147,030

[45] Apr. 3, 1979

[54] ENGINE EXHAUST GAS PURIFICATION SYSTEM

[75] Inventors: Eturou Katahira; Shunzo Yamaguchi, both of Okazaki; Masashi Kida, Nishio; Yasuhiko Ishida, Susono, all of Japan

[73] Assignees: Nippon Soken, Inc., Nishio; Toyota Jidosha Kogyo Kabushiki Kaisha, Toyota, both of Japan

[21] Appl. No.: 777,651

[22] Filed: Mar. 15, 1977

[30] Foreign Application Priority Data

Apr. 19, 1976 [JP] Japan ..... 51/44652

[51] Int. Cl.[2] ..... F01N 3/10

[52] U.S. Cl. ..... 60/276; 60/290

[58] Field of Search ..... 60/276, 290, 289

[56] References Cited

U.S. PATENT DOCUMENTS

| | | | |
|---|---|---|---|
| 3,911,674 | 10/1975 | Goto | 60/290 |
| 3,962,867 | 6/1976 | Ikeura | 60/290 |
| 4,007,718 | 2/1977 | Laprade | 60/276 |
| 4,037,406 | 7/1977 | Hartel | 60/276 |

*Primary Examiner*—Douglas Hart

*Attorney, Agent, or Firm*—Cushman, Darby & Cushman

[57] ABSTRACT

An engine exhaust gas purification system having an exhaust gas reactor mounted on the engine exhaust pipe, a secondary air supply system having a secondary air supply passage connected to the exhaust pipe upstream of the reactor, and an exhaust gas air-fuel ratio detector mounted on the exhaust pipe to detect air-fuel ratio of exhaust gases in the exhaust pipe. A secondary air supply control valve is provided in the secondary air supply passage and controlled by a valve actuator having a diaphragm to which positive pressure of the secondary air and the engine intake vacuum pressure can be applied. The application of the positive and vacuum pressures to the diaphragm is controlled by solenoid valves which are controlled in accordance with the air-fuel detector output voltage which represents the detected exhaust gas air-fuel ratio, whereby the secondary air supply control valve is controlled such that the secondary air is supplied to the engine exhaust gases at a continuously controlled, variable rate.

6 Claims, 7 Drawing Figures

ENGINE EXHAUST GAS PURIFICATION SYSTEM

BACKGROUND OF THE INVENTION

1. Field of the Invention

The present invention relates to an exhaust gas purification system for an internal combustion engine and, more particularly, to an engine exhaust gas purification system of the type which uses an exhaust gas air-fuel ratio detector to control a secondary air supply so that the engine gases flow into an exhaust gas reactor at an air-fuel ratio which is optimum for the exhaust gas purification performance of the reactor. By the term "exhaust gas air-fuel ratio" (or "air-fuel ratio of exhaust gas") used herein, it is meant to say a ratio of the total of the amount of air introduced into the intake system of an engine and the amount of a secondary air introduced into the engine exhaust gases to the amount of a fuel supplied into the engine.

2. Description of the Prior Art

One type of the exhaust gas reactor used a catalyst of a type which is operative to simultaneously facilitate oxidization of carbon monoxide (CO) and hydrocarbon (HC) contained in engine exhaust gases and reduction of nitrogen oxides $NO_x$) also contained in the exhaust gases. This type of catalyst has an inherent operating characteristic such that the catalyst exhibits its maximum performance only for an extremely limited range of the air-fuel ratio of the exhaust gases to be processed. For a different type of catalyst and for a different type of reactor (such as after-burner type reactor), there are different ranges of exhaust gas air-fuel ratio which are most suited for the optimum performances of the different type of catalyst and for the different type of reactor.

In general, it is known to use an exhasut gas air-fuel ratio detector to control a secondary air supply to engine exhaust gases. However, exhaust gas air-fuel ratio control generally used in the prior art, it is difficult to keep the exhaust gas air-fuel ratio within an optimum range throughout all the operating ranges of the engine. For this reason, it was impossible to enable the exhaust gas reactor to operate at its maximum exhaust gas purification performance throughout the operating range of engine.

SUMMARY OF THE INVENTION

It is an object of the present invention to control a secondary supply of air to engine exhaust gases such that the air-fuel ratio of exhaust gases to be processed by an exhaust gas reactor is held substantially within a range which is most suited for the inherent operating characteristics of the reactor.

The engine exhaust gas purification system according to the present invention comprises a valve means including a valve member disposed in a secondary air supply passage for controlling the supply of secondary air into engine exhaust gases flowing through an engine exhaust pipe. A valve actuator defining therein a pressure chamber and including a diaphragm bordering the chamber is operatively connected to the valve member. A first pipeline introduces a positive fluid pressure into the pressure chamber and a second pipeline introduces a vacuum pressure into the pressure chamber. First and second solenoid valves are respectively provided in the first and second pipelines to control the introduction of the positive and vacuum pressures through the first and second pipelines into the pressure chamber. An exhaust gas air-fuel ratio detector is disposed in the path of exhaust gas flow through the exhaust pipe downstream of the connection between the exhaust pipe and the secondary air supply passage. Means associated with the exhaust gas air-fuel ratio detector and with the solenoid valves is operative to compare the detector output signal with a reference signal to control the operations of the solenoid valves. The valve actuator is controlled such that the secondary air is supplied to the engine exhaust gases at a continuously controlled, variable rate.

In an embodiment of the invention, fixed restrictions are respectively provided in the first and second pipelines for limiting the fluid flows therethrough. The secondary air supply control valve member is thereby prevented from being moved to any of the fully-open and fully-closed positions in the case where the positive pressure or the vacuum pressure is allowed to pass through the corresponding solenoid valve for only a short period of time. In another embodiment of the invention, the first and second pipelines are provided with auxiliary solenoid valves, respectively, in place of the fixed restrictions. The auxiliary solenoid valves are controlled by an oscillator such that the valves are periodically opened and closed. Preferably, the oscillator may be operated in accordance with the operating conditions of the engine to vary the ratio of the period of time while each of the auxiliary solenoid valves is open to the period of time while the auxiliary solenoid valve is closed. The engine operating conditions may be determined preferably on the basis of the speed of change of the opening of the engine throttle valve (i.e., the speed of pivotal movement of the throttle valve from one position to another). The auxiliary solenoid valves may preferably be controlled such that, during normal engine operation, the valve-open duration of each auxiliary solenoid valve is shorter than the valve-closed duration thereof and such that, during a transition operation of the engine, the valve-open duration of each auxiliary solenoid valve is longer than the valve-closed duration thereof. In all of the embodiments, the first pipeline may preferably be connected to the secondary air supply passage to introduce the secondary air into the pressure chamber of the valve actuator and the second pipeline may preferably be connected to an intake pipe of the engine to transmit the engine intake vacuum into the pressure chamber.

With the exhaust gas purification system of the present invention, the secondary air supply system is reliably operative to control and keep the exhaust gas air-fuel ratio at a value which is most suited for the optimum performance of the exhaust gas reactor during normal operation of engine. The secondary air supply system is quickly responsive to a transition operation of the engine to control the exhaust gas air-fuel ratio. The secondary air supply system is thus operative to control the exhaust gas air-fuel ratio throughout all the operating ranges of engine and even during an accelerating operation wherein the production of $NO_x$ is increased. Accordingly, the secondary air supply system is capable of minimizing the variation in the air-fuel ratio of engine exhaust gases as measured at the reactor to enable the same to provide its maximum exhaust gas purification performance. In addition, because the air-fuel ratio of engine exhaust gases is controlled by the supply of secondary air, the emisson control according to the present invention hardly adversely affects the engine performance even during a transition operation even if the secondary air is supplied in an intermittent or discontinuous manner.

The above and other objects, features and advantages of the present invention will be made apparent by the following description with reference to the accompanying drawings.

DESCRIPTION OF PREFERRED EMBODIMENTS

Figure 2:
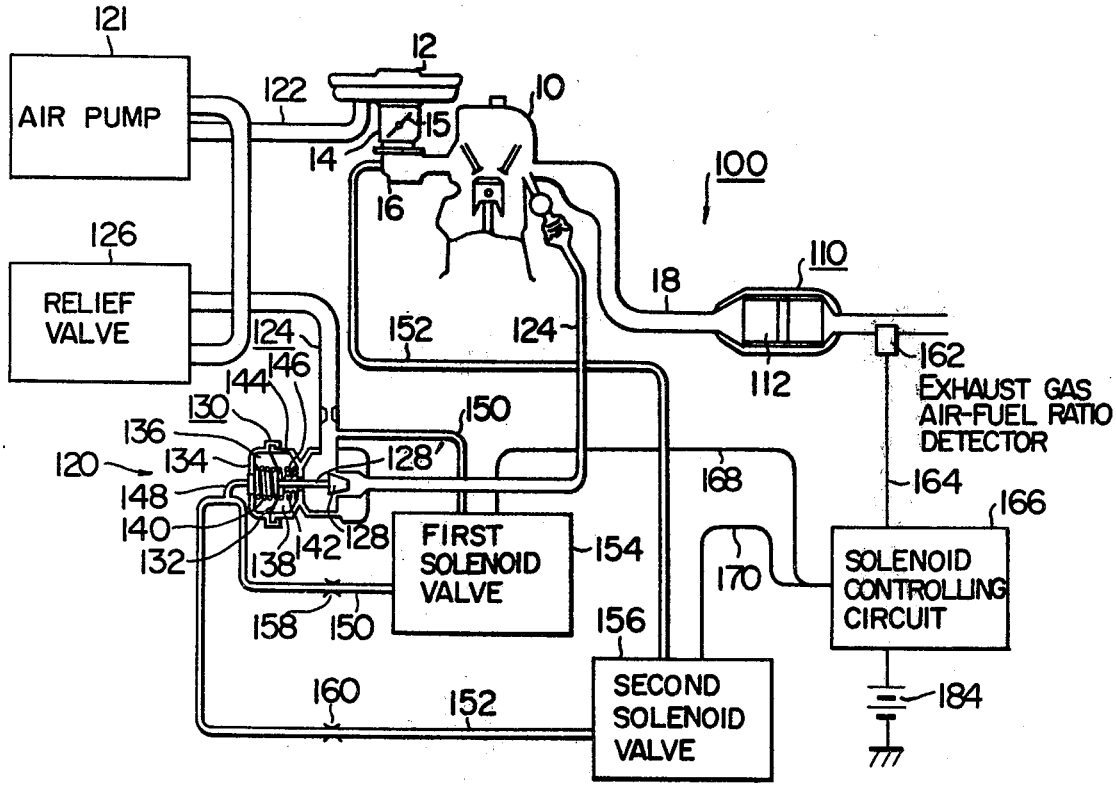
FIG. 2 is a partly sectional, diagrammatic illustration of a first embodiment of the present invention.

Referring first to FIG. 2, a conventional internal combustion engine is designated by reference numeral 10 and includes an air cleaner 12, a carburetor 14, an intake pipe 16 and an exhaust pipe 18. The carburetor 14 is so adjusted as to produce an air-fuel mixture which is somewhat richer than an air-fuel mixture usually produced for an internal combustion engine. In other words, the air-fuel mixture produced by the carburetor 14 is somewhat richer than the air-fuel mixture which is of such an air-fuel ratio as is suited for the most optimum exhaust gas purification operation of an exhaust gas reactor. The flow of air from the air cleaner 12 into the carburetor 14 is controlled by a throttle valve 15 and is mixed with a corresponding amount of fuel to form an air-fuel mixture which is fed through the intake pipe 16 into the engine 10 for the combustion therein. The combustion products, i.e., the engine exhaust gases, are discharged through the exhaust pipe 18 into the atmosphere.

Figure 1:
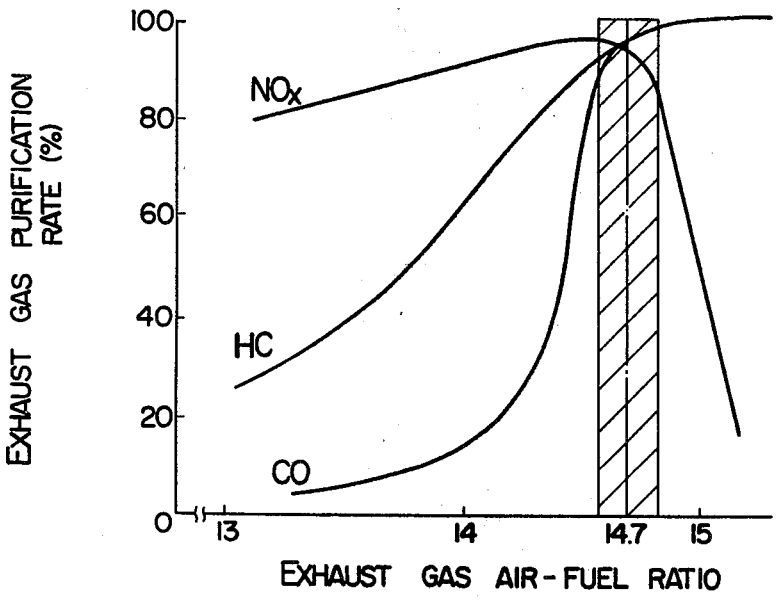
FIG. 1 is a graphical illustration of an exhaust gas purification performance of a catalyst used in preferred embodiments of an engine exhaust gas purification system according to the present invention.

An exhaust gas purification system generally designated by 100 is provided for the engine 10 and includes an exhaust gas reactor 110 disposed in the exhaust pipe 18. The structure itself of the exhaust gas reactor 110 is not a part of the invention and it will be sufficient to make a reference that the reactor includes a catalyst bed 112 which carries a catalyst which facilitates oxidization of carbon monoxide (CO) and hydrocarbon (HC) contained in the exhaust gases and reduction of nitrogen oxides ($NO_x$) also contained therein thereby to purify the exhaust gases. An example of the catalyst is platinum-rhodium. FIG. 1 graphically illustrates the exhaust gas purification performance of this type of catalyst. As will be seen in the graphical illustration, the catalyst is operative to purify engine exhaust gases at a high purification rate with respect to all of CO, HC and $NO_x$ when the air-fuel ratio of exhaust gases is around the stoichiometrical air-fuel ratio (14.7 in a case where gasoline is used as fuel). As defined previously, the term "air-fuel ratio of exhaust gases" or the like used herein means a ratio of the total of the amount of air introduced into the intake system of engine and the amount of secondary air introduced into the engine exhaust system to the amount of fuel supplied into the engine.

The exhaust gas purification system 100 further includes a secondary air supply system which is generally designated by 120 annd comprises an air pump 121 drivingly connected to the engine 10 (the connection is not shown). The intake port of the air pump 121 is pneumatically connected by a pipe 122 to th air cleaner 12 of the engine, while the delivery port of the pump 121 is pneumatically connected to the engine exhaust pipe 18 upstream of the exhaust gas reactor 110 by a second pipe 124. Pipe 124 defines therein a secondary air supply passage in which a relief valve 126 is disposed adjacent to the air pump 121. A valve 128 is provided in the secondary air supply passage 124 between the relief valve 126 and th exhaust pipe 18 and operated by a valve actuator 130 to control the flow of secondary air from the air pump 121 into the exhaust pipe 18.

The valve actuator 130 includes a diaphragm 132 disposed in a housing 134 and dividing the interior thereof into two chambers 136 and 138. Compression coil springs 140 and 142 are disposed in the chambers 136 and 138 respectively to elastically support the diaphragm 132 axially thereof. The chamber 138 is vented by a vent hole 144 formed in the housing 134. The valve 128 has a stem portion 128' slidably extending into the vented chamber 138 and is connected to the diaphragm 132 for movement therewith. A bellows member 146 is disposed inwardly of the turns of the spring 142 and extends around and over the valve stem 128' to seal the secondary air supply passage 124 from the atomosphere.

The chamber 136 has a pneumatic pressure inlet port 148 pneumatically connected to the secondary air supply passage 124 between the relief valve 126 and the secondary air control valve 128 and to the intake pipe 16 of the engine 10 by a positive pressure conduit 150 and by a vacuum conduit 152, respectively, so that either the positive air pressure produced by the air pump 121 or the intake vacuum produced in the intake pipe 16 of the engine can be introduced through the conduit 150 or 152 into the chamber 136 in the valve actuator 130 and exerted to the diaphragm 132 therein for the displacement of the diaphragm.

The introduction of the positive air pressure and the engine intake vacuum into the chamber 136 is controlled by first and second selenoid valves 154 and 156 disposed in the conduits 150 and 152, respectively. The first solenoid valve 154, when electrically energized, is opened so that the pressurized air from the air pump flows through the conduit 150 into the chamber 136. The second solenoid valve 156, when electrically deenergized, is opened so that the engine intake vacuum is transmitted through the conduit 152 into the chamber 136. Fixed restriction orifices 158 and 160 are preferably provided in the conduits 150 and 152 between the chamber 136 and the first solenoid valve 154 and between the chamber 136 and the second solenoid valve 156, respectively, to allow flows of fluid through the conduits 150 and 152 at predetermined rates, respectively. Alternatively, the conduits 150 annd 152 may be of sizes having predetermined inner diameters, respectively. This enables the valve actuator 130 to control the secondary air control valve member 128 such that the latter is continuously located at an optimum part-open position.

Figure 3:
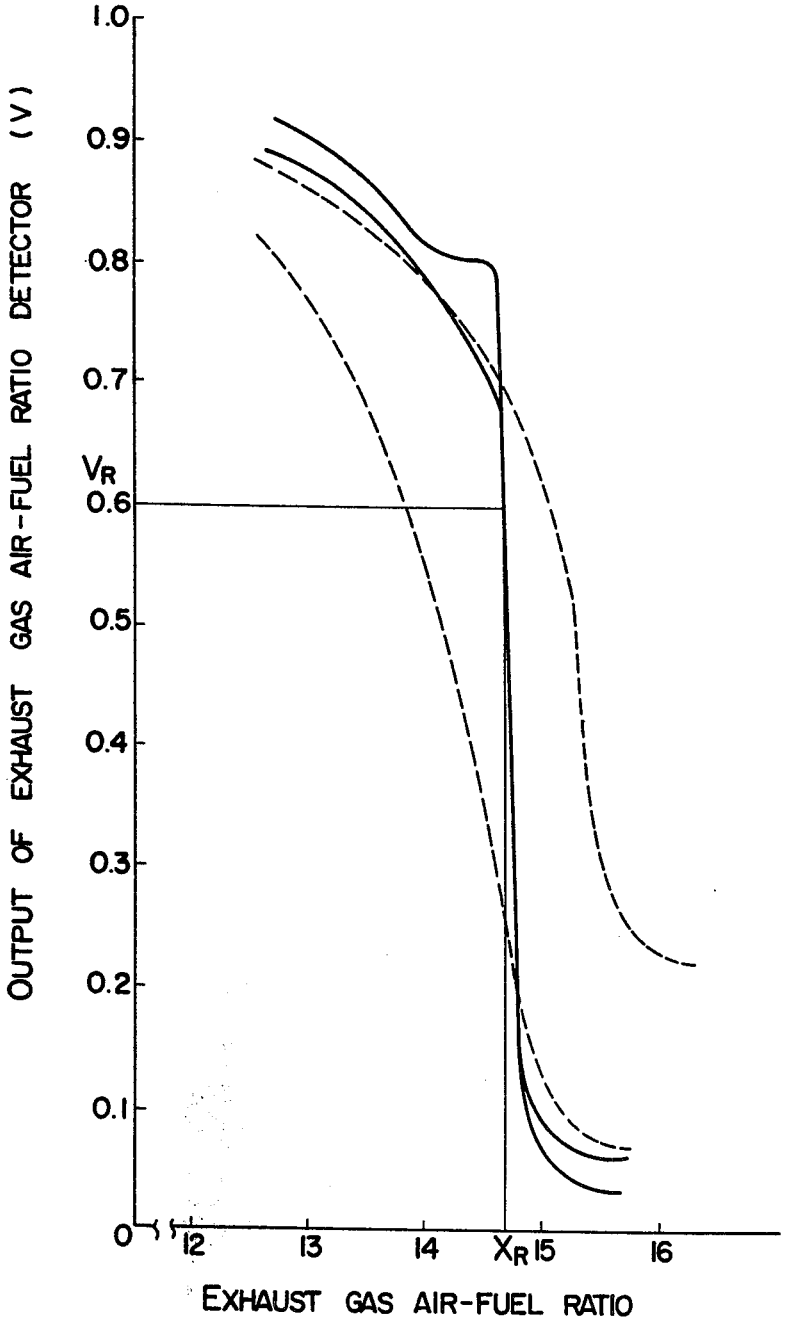
FIG. 3 graphically illustrates the operating characteristics of an air-fuel ratio detector shown in FIG. 2.

An exhaust gas air-fuel ratio detector 162 is mounted on the exhaust pipe 18 and protrudes into the path of the exhaust gas flow through the pipe. In the embodiment of the invention, the detector 162 is of a conventional type which includes zirconium dioxide and detects the air-fuel ratio of the engine exhaust gases on the basis of the oxygen content of the exhaust gases to produce an output voltage corresponding to the detected exhaust gas air-fuel ratio. The operating characteristics of the detector 162 is shown in FIG. 3 by two generally Z-shaped solid lines which overlap each other at the intermediate portions of the lengths thereof. In principle, the exhaust gas air-fuel ratio detector 162 may be positioned in the path of the exhaust gas flow through the exhaust pipe 18 downstream of the point of connection between the pipe 18 and the secondary air supply pipe 124 so that the detector 162 is exposed to the engine exhaust gases after the gases have been supplied with secondary air by the secondary air supply system 120. It is, however, preferred that the detector 162 is disposed downstream of the exhaust gas reactor 110, as shown in FIG. 2. The reason for this is firstly that, because the catalyst in the exhaust gas reactor 110 is activated, the temperture of the exhaust gases just downstream of the reactor 110 is substantially stable regardless of various operating conditions of the engine 10 with a result that the detector 162 is operated under the substantially stable temperature. Secondly, the detector 162 when disposed just downstream of the reactor 110 exhibits a more stable and desirable Z-shaped output characteristics (as shown by the solid lines in FIG. 3) regardless of the air-fuel ratio of the engine exhaust gases compared with the case where the detector 162 is disposed upstream of the reactor 110. For example, with the detector 162 positioned upstream of the reactor 110 and for the same exhaust gas air-fuel ratio as in the case where the detector is positioned downstream of the reactor, the output curves of the detector 162 shown by broken lines is FIG. 3 are considerably deformed from the inherent Z-shaped characteristic curves shown by the solid lines which suddenly and steeply rise with a minor decrease in the air-fuel ratio. On the other hand, the broken line curves rise loosely and gradually.

Figure 4:
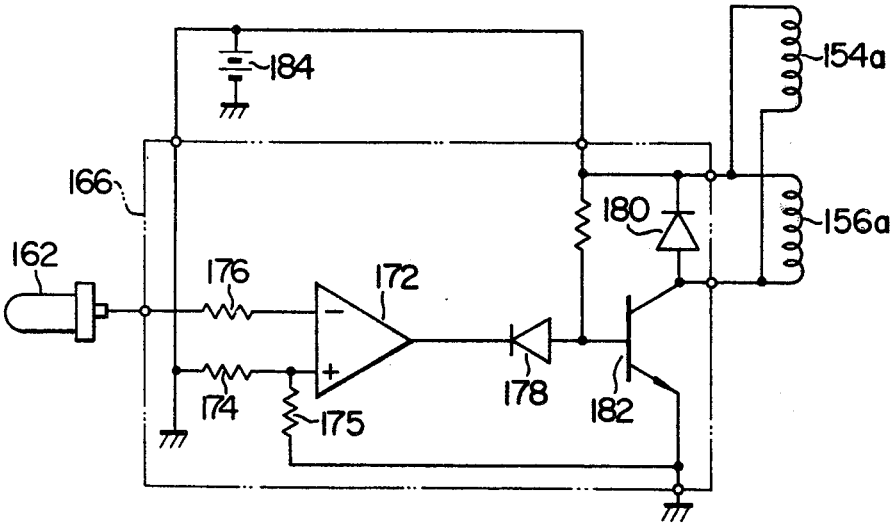
FIG. 4 is an electric wiring diagram of a controlling circuit shown in FIG. 2.

The exhaust gas air-fuel ratio detector 162 is electrically connected by a conductor 164 to an electric controlling means 166 which in turn is electrically connected by conductors 168 and 170 to the first and second solenoid valves 154 and 156, respectively. The controlling means 166 comprises electric circuits shown in FIG. 4. The circuits include a comparator 172 having a plus (+) terminal to which a reference voltage preset by resistors 174 and 175 is applied. A voltage generated by the exhaust gas air-fuel ratio detector 162 and controlled by a third resistor 176 is applied to a minus (−) terminal of the comparator 172. The electric controlling means 166 further includes diodes 178 and 180 and a transistor 182 which are connected as shown in FIG. 4. Reference numerals **154*a* and 156*a* designate solenoids of the first and second solenoid valves 154 and 156, respectively. Reference numeral 184** indicates a power source.

In operation, when the air-fuel ratio of the engine exhaust gases at the point just downstream of the exhaust gas reactor 110 is smaller (richer) than a target air-fuel ratio $X_R$ marked in FIG. 3, the detector 162 generates an output voltage which is higher than a target voltage $V_R$ also marked in FIG. 3, so that the input voltage to the minus terminal of the comprator 172 is higher than the preset reference voltage applied to the plus terminal of teh comparator 172. Comparator 172 is thus rendered "O" level, whereby the solenoids **154*a* and 156*a* are deenergized. On the other hand, when the exhaust gas air-fuel ratio is larger (leaner) than the target air-fuel ratio $X_R$, the output voltage of the detector 162 is lower than the target voltage $V_R$, so that the input voltage to the minus terminal of the comparator 172 is lower than the preset reference voltage applied to the plus terminal of the comparator. The latter is thus rendered "1" level and the solenoids 154*a* and 156*a* are energized. The first and second solenoid valves 154 and 156 are therefore controlled in accordance with the output voltages of the exhaust gas air-fuel ratio detector 162 and thus in accordance with the air-fuel ratio of the engine exhaust gases so that the secondary air control valve 128 and the actuator 130** therefor are controlled as follows:

When the exhaust gas air-fuel ratio is smaller than the target air-fuel ratio $X_R$, the solenoids 154 and 156 of the first and second solenoid valves are both deenergized, as discussed above. Thus second solenoid valve 156 alone is operative to transmit the engine intake vacuum through the vacuum conduit 152 into the chamber 136 of the valve actuator 130. The diaphragm 132 of the actuator 130 is thus pulled leftward, as viewed in FIG. 2, to move the valve member 128 in a valve-opening direction. If the vacuum is continuously applied to the actuator 130 for a long period of time, the valve member 128 is moved to its fully-opened position with resultant increase in the secondary air supply to the engine exhaust gases and rapid increase in the exhaust gas air-fuel ratio. On the other hand, when the exhaust gas air-fuel ratio is larger than the target air-fuel ratio $X_R$, the solenoids **154*a* and 156*a* of the first and second solenoid valves 154 and 156 are both energized, so that the first solenoid valve 154 alone is operative to allow the flow of secondary air through the positive air pressure conduit 150 into the chamber 136 of the valve actuator 130. The diaphragm 132 of the actuator 130 is thus urged to the right, as viewed in FIG. 2, to move the valve member 128 in a valve-closing direction. If the positive air pressure is continuously applied to the diaphragm 132 for a long period of time, the valve member 128** is moved to its fully-closed position to interrupt the supply of secondary air to the engine exhaust gases, so that the exhaust gas air-fuel ratio is rapidly decreased.

The restriction orifices 158 and 160 provided in the conduits 150 and 152 are operative to assure that, in the case where the positive air pressure or the enngine intake vacuum is introduced into the chamber 136 of the valve actuator 130 for a short period of time, the valve member 128 is moved to neither the fully-opened nor fully-closed position. In this case, the position of the valve member 128 is controlled in accordance with the ratio between the periods of time while the positive air pressure and engine intake vacuum are introduced into the actuator chamber 136, respectively, and in accordance with the absolute pressures of the positive air pressure and the engine intake vacuum, whereby the supply of the secondary air to the engine exhaust gases is correspondingly controlled. The above-described operations are repeated such that the ratio between the durations of the introductions of positive air pressure and engine intake vacuum into the valve actuator chamber 136 becomes substantially constant and the secondary air control valve member 128 is kept open at a substantially constant degree of opening to assure secondary air supply to the engine exhaust gases at a certain stable rate thereby attaining the target air-fuel ratio $X_R$ of the engine exhaust gases.

With the apparatus described above, the secondary air control valve member 128 can be kept at a normal open position at an adequate degree of opening under normal engine operation, so that variation in the rate of secondary air supply is decreased with resultant advantage that the air-fuel ratio of the engine exhaust gases can be maintained within the optimum range for the exhaust gas purification performance of the catalyst throughout all the operating conditions of the engine. In addition, internal combustion engines designed to meet with the governmental emission control regulation have a tendency to increase the air-fuel ratio of an air-fuel mixture during an accelerating operation so as to suppress an increase in the emission of harmful components of engine exhaust gases which is otherwise caused at that time. With the exhaust gas purification system of the described embodiment of the invention, however, an accelerating operation of the engine 10 is accompanied by an increase in the secondary air pressure due to the speed-up of the engine operation and thus the speed-up of the pump 121 and also by an increase in the absolute pressure of the engine intake vacuum due to a wide-open position of the throttle valve, with a result that the secondary air control valve member 128 is moved toward its closed position during engine acceleration.

Figure 5:
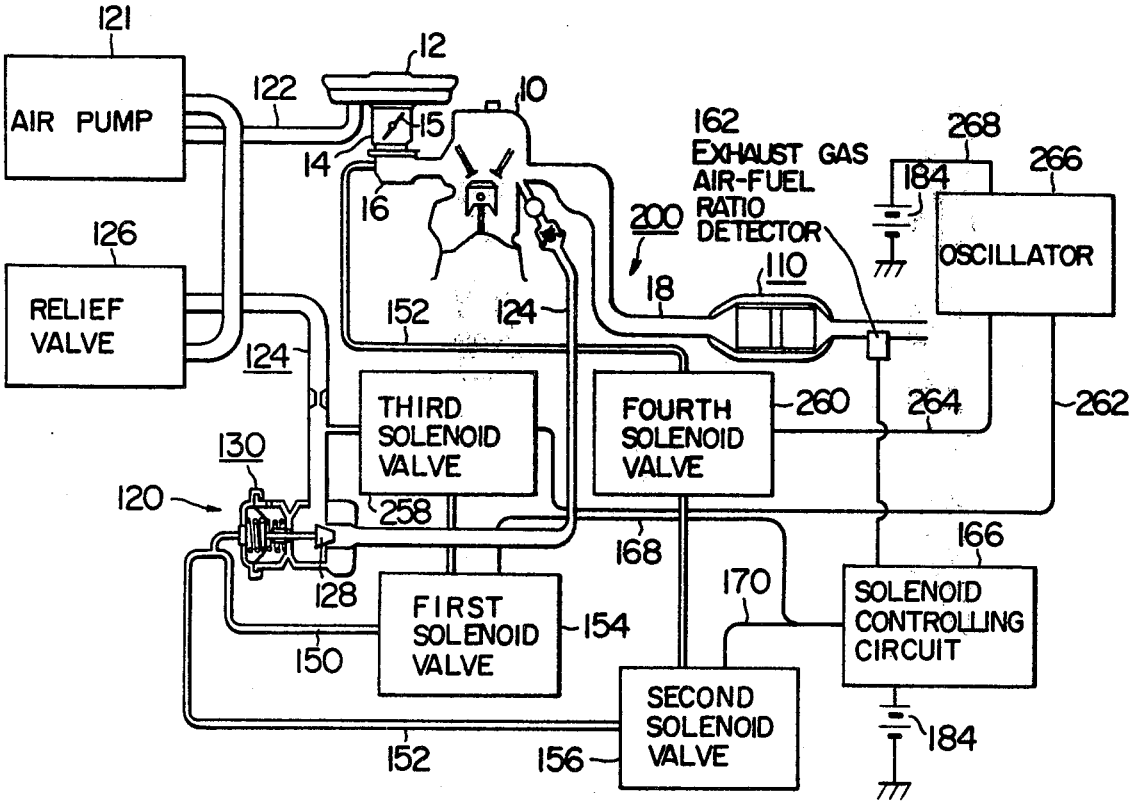
FIGS. 5 and 6 are views similar to FIG. 2 but illustrate second and third embodiments of the present invention, respectively.

FIG. 5 illustrates a second embodiment of the invention generally designated by reference numeral 200. Parts of the embodiments 200 similar to those of the first embodiment 100 are designated by similar reference numerals. The embodiment 200 is substantially similar to the first embodiment 100 except for the following points:

In place of the restriction orifices 158 and 160 provided in the first embodiment, the second embodiment is provided with third and fourth solenoid values 258 and 260 disposed in the positive air pressure conduit 150 and the vacuum conduit 152 in series relationship to the first and second solenoid valves 154 and 156, respectively. The third and fourth solenoid valves 258 and 260 are electricaly connected by conductors 262 and 264 to an oscillator 266 so that the solenoid valves are periodically opened and closed by the operation of the oscillator 266 rather than by the exhaust gas air-fuel ratio detector 162, the oscillator 266 being electrically connected by a conductor 268 to the power source 184. The opening and closing operations of the third and fourth solenoid valves 258 and 260 reform the substantially continuous pneumatic pressures from the air pump 121 and from the engine intake pipe 16 into discontinuous and pulsated pneumatic pressures which are then transmitted to the first and second solenoid valves 154 and 156, respectively. It is to be noted that the duty ratio of these solenoid valves 258 and 260 can be freely varied by changing the duty ratio of the utput pulses from the oscillator 266. This feature of the second embodiment of the invention ensures that the movement of the secondary air supply control valve member 128 during normal engine operation can be more freely controlled than in the first embodiment and thus the valve member 128 can be kept open at an optimum degree of opening, whereby the second embodiment improves the operation of the first embodiment.

Figure 6:
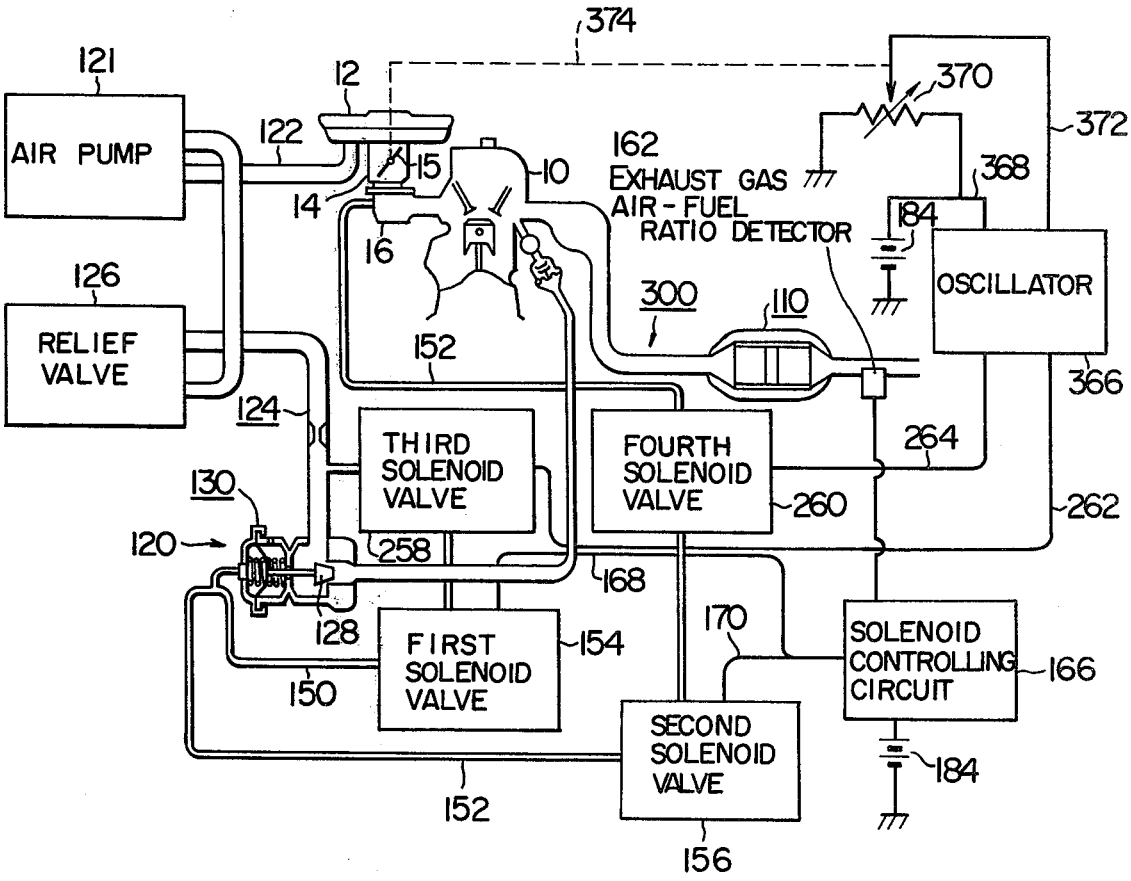

FIG. 6 illustrates a third embodiment of the invention which is generally designated by reference numeral 300 and is substantially similar in structure to the second embodiment 200 except for the points to be described hereunder. Parts of the third embodiment 300 similar to those of the second embodiment 200 are designated by similar reference numerals. In addition to substantially all the elements of the second embodiment 200 of the invention, the third embodiment 300 further includes a potentiometer 370 which is electrically connected by a conductor 372 to an oscillator 366 and operatively associated with the engine throttle valve 15, as shown by a broken line 374 in FIG. 6. The oscillator 366 includes electric circuits shown in FIG. 7 and is slightly modified from the oscillator 266 used in the second embodiment 200. The potentiometer 370 is operative to detect the speed of the change in the opening of the throttle valve 15 and emit a corresponding output signal. The oscillator 366 is responsive to the signal from the potentiometer to control the ratio of the period of time while the third and fourth solenoid valves 258 and 260 are open to the period of time while these solenoid valves are closed. More specifically, the oscillator 366 is operative to control the third and fourth solenoid valves 258 and 260 such that the valve-open duration of each of these solenoid valves 258 and 260 during a transition operation of the engine is longer than the valve-open duration during a normal operation of the engine.

Figure 7:
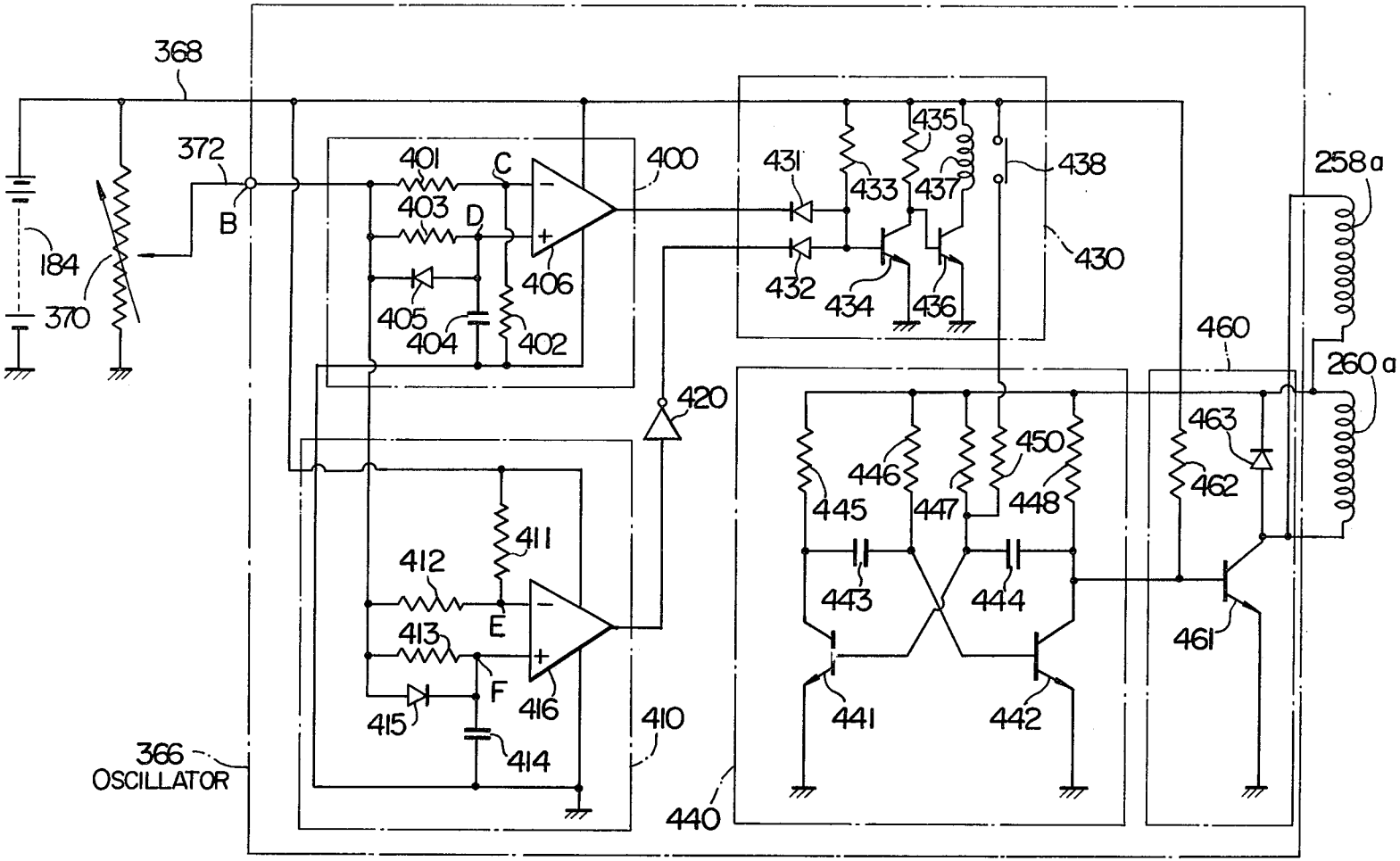
FIG. 7 is an electric wiring diagram showing the detailed construction of the oscillator shown in FIG. 6.

The construction and operation of the oscillator 366 will be described in detail hereunder with reference to FIG. 7, wherein numeral 400 designates an acceleration detecting circuit comprising resistors 401, 402 and 403, a capacitor 404, a diode 405 and an operational amplifier 406. The resistors 401 and 403 are connected to a terminal B to which is applied a signal voltage ($V_B$) representing a position of the throttle valve 15. A voltage ($V_C$) at a junction C of the resistors 401 and 402 is applied to an inverting terminal ("−" terminal) of the amplifier 406, while a voltage ($V_D$) at a junction D of the resistor 403 and the capacitor 404 is applied to a non-inverting terminal ("+" terminal) of the amplifier 406. Relationship between $V_C$ and $V_D$ is so determined that $V_D$ is larger than $V_C$ during the normal running operation of the engine (that is, during a time when the throttle valve 15 is kept substantially stationary at a position), so that a "1" level signal is produced at an output terminal of the amplifier 406 during the normal running operation of the engine.

On the other hand, on a rapid change of the opening of the throttle valve 15, such as a rapid acceleration, the voltage $V_C$ is increased immediately (without any time delay) in response to the increase in the signal voltage $V_B$, while the voltage $V_D$ is gradually increased with a time delay caused by an integration circuit of the resistor 403 and the capacitor 404, so that the voltage $V_D$ becomes and is kept smaller than the voltage $V_C$ during a certain period of time. Thereore, the output of the amplifier 406 is changed from "1" level to "0" level for the period while the engine is abruptly accelerated. After that period has lapsed, the output of the amplifier 406 is again restored to its normal level ("1" level).

Numeral 410 designates a deceleration detecting circuit comprising resistors 411, 412 and 413, a capacitor 414, a diode 415 and an operational amplifier 416. The resistors 412 and 413 are connected to the terminal B. A voltage ($V_E$) at a junction E of the resistors 411 and 412 is applied to an inverting terminal ("−" terminal) of the amplifier 416, while a voltage ($V_F$) at a junction F of the resistor 413 and the capacitor 414 is applied to a non-inverting terminal ("+" terminal) of the amplifier 416. Relationship between voltages $V_E$ and $V_F$ is so determined that $V_E$ is larger than $V_F$ during the normal running operation of the engine (that is, during a time while the throttle valve 15 is substantially stationary at a position), so that a "0" level signal is produced at an output terminal of the amplifier 416 during the normal running operation of the engine.

On the other hand, during a rapid deceleration of the engine wherein the throttle valve 15 is rapidly moved toward its closed position, the voltage $V_E$ is decreased without any time delay in response to the decrease in the signal voltage $V_B$, while the voltage $V_F$ is gradually decreased with a certain time delay caused and determined by the integration circuit of the resistor 413 and the capacitor 414, so that the voltage $V_E$ becomes and is kept smaller than the voltage $V_F$ during a certain period of time. Therefore, the output of the amplifier 416 is changed from "0" to "1" level for that period. After the period of time has lapsed, the output of the amplifier 416 is restored to its normal level ("0" level). During the above-described rapid deceleration of the engine, the charge on the capacitor 404 of the acceleration detecting circuit 400 is also rapidly discharged through the diode 405 so that no change of the output of the amplifier 406 takes place. During the above-described rapid acceleration of the engine, the capacitor 414 of the deceleration detecting circuit 410 is rapidly charged in response to the rapid increase in the signal voltage $V_B$, so that no change of the output of the amplifier 416 takes place. As such, the acceleration and deceleration detecting circuits 400 and 410 are well responsive to the operating conditions of the engine even if the rapid acceleration and deceleration are respected.

The output of the amlifier 406 is applied to a switching circuit 430, while the output of the amplifier 416 is applied thereto through an inverter 420. The switching circuit 430 includes diodes 431 and 432 respectively connected to the acceleration and deceleration detecting circuits 400 and 410, a first transistor 434 having a base connected to the diodes 431 and 432 and also connected through a resistor 433 to the battery 184, a second transistor 436 having a base connected to the collector of the first transistor 434 and also connected through a resistor 435 to the battery, a relay coil 437 connected to the battery 184 and to the transistor 436 in series relationship to the collector-emitter path of the transistor 436, and relay contacts 438 disposed adjacent to the relay coil 437 and adapted to be closed when the relay coil 437 is energized.

During the normal running operation of the engine, "1" level signals are respectively applied to the diodes 431 and 432 as described above, so that the second transistor 436 is kept non-conductive keeping the relay contacts 438 opened. On the other hand, when either the rapid acceleration or deceleration of the engine occurs, a "0" level signal is applied to either the diode 431 or the diode 432 to drive the first transistor 434 into non-conductive state, whereby the relay coil 437 is energized to close the relay contacts 438.

Numeral 440 designates a well-known astable multivibrator comprising transistors 441 and 442, capacitors 443 and 444, and resistors 445, 446, 447 and 448. The multivibrator 440 further includes a resistor 450 connected to the battery 184 through the relay contacts 438.

Accordingly, a duration while the transistor 442 is non-conductive in the case where the relay contacts 438 are closed is longer than in the case where the relay contacts 438 are opened.

Numeral 460 designates an energization circuit comprising a transistor 461 having a base connected to the collector of the transistor 442, a resistor 462 and a diode 463. The circuit 460 energizes solenoid coils **258*a* and 260*a* of the third and fourth solenoid valves 258 and 260 in response to the oscillation of the multivibrator 440. Accordingly, the energization period of these solenoid coils 258*a* and 260*a* during a time while the relay contacts 438 are kept closed is longer than that during a time while the relay contacts 438 are kept open. Therefore, the period of time while the positive air pressure conduit 150 and the vacuum conduit 152** are kept in conductive states during the transition operation of the engine is longer than in the normal operation of the engine.

Thus, compared with the first embodiment of the invention, the third embodiment is responsive more quickly to changes in the exhaust gas air-fuel ratio which are caused by changes in the engine operating conditions, thereby to more adequately and reliably control the secondary air supply.

The exhaust gas reactor 110 employed in the described embodiments of the invention has been described as being of the type that uses the above-described type of catalyst. The present invention, however, is not limited to the use of this type of reactor but may use another type of reactor, such as an afterburner. In the latter case, the secondary air supply should be controlled so as to be at a rate which is suited to the exhaust gas air-fuel ratio at which the other type of exhaust gas reactor exhibits its optimum exhaust gas purification performance. As an example, in the case where the exhaust gas reactor 110 is either of the type that uses an oxidizing catalyst or in the form of an afterburner, the reactor exhibits a high exhaust gas purification rate when the exhaust gas air-fuel ratio is larger than the stoichiometrical air-fuel ratio. In this case, therefore, the exhaust gas air-fuel ratio detector 162 should be disposed upstream of the reactor and the secondary air supply system is controlled such that the exhaust gas air-fuel ratio as measured at that point of the exhaust system is around the stoichiometrical air-fuel ratio. In addition, an additional secondary air is always supplied at a small rate to the engine exhaust gases at a point between the air-fuel ratio detector and the reactor to ensure that the air-fuel ratio of the exhaust gases flowing into the reactor is always larger than the stoichiometrical air-fuel ratio so that the reactor of the type used exhibits the high exhaust gas purification rate.

What is claimed is:

1. In an engine exhaust gas purification system of the type which comprises an exhaust gas reactor mounted on an exhaust pipe of an internal combustion engine, a secondary air supply system including a secondary air supply passage connected to said engine exhaust pipe upstream of said reactor, and a detector disposed in the path of exhaust gas flow through said exhaust pipe downstream of the connection between said exhaust pipe and said secondary air supply passage to detect the air-fuel ratio of the exhaust gases to emit a corresponding output signal whereby the secondary air supply system is controlled to keep the engine exhaust gas air-fuel ratio substantially at an optimum value, wherein the improvement comprises:

a valve means including a valve member disposed in said secondary air supply passage for controlling the supply of secondary air into engine exhaust gases flowing through said exhaust pipe;

a valve actuator defining therein a pressure chamber and including a diaphragm bordering said chamber and operatively connected to said valve member;

a first pipeline for introducing a positive fluid pressure into said pressure chamber;

a second pipeline for introducing a vacuum pressure into said pressure chamber;

a first set of main and auxiliary solenoid valves disposed in said first pipeline in series relationship with each other to control the introduction of the positive pressure through said first pipeline into said pressure chamber;

a second set of main and auxiliary solenoid valves disposed in said second pipeline in series relationship with each other to control the introduction of the vacuum pressure through said second pipeline into said pressure chamber;

means associated with said exhaust gas air-fuel ratio detector and with said main solenoid valves of said first and second sets and being operative to compare the detector output signal with a reference signal thereby for controlling the operations of said main solenoid valves; and an oscillator operative to periodically open and close said auxiliary solenoid valves of said first and second sets;

said valve actuator being controlled such that the secondary air is supplied to the engine exhaust gases at a continuously controlled, variable rate.

2. The exhaust gas purification system according to claim 1, wherein said oscillator is operative in accordance with the operating conditions of the engine to vary the ratio of the period of time while each of said auxiliary solenoid valves is open to the period of time while the auxiliary solenoid valve is closed.

3. The exhaust gas purification system according to claim 1, wherein said oscillator is operative to control said auxiliary solenoid valves such that the valve-open duration of each auxiliary solenoid valve during a transition operation of the engine is longer than that during a normal operation of the engine.

4. The exhaust gas purification system according to claim 1, wherein said first pipeline is connected to said secondary air supply passage to introduce the secondary air into said pressure chamber of said valve actuator and said second pipeline is connected to an intake pipe of said engine to transmit engine intake vacuum into said pressure chamber.

5. An engine exhaust gas purification system for an internal combustion engine having an intake pipe for supplying an air-fuel mixture, a combustion chamber adapted to be communicated with said intake pipe for receiving the mixture therefrom, an exhaust pipe adapted to be communicated with said combustion chamber for conveying exhaust gases to the atmosphere, and an exhaust gas reactor disposed in said exhaust pipe for purifying the exhaust gases, said system comprising:

air-fuel ratio detecting means mounted in said exhaust pipe downstream of said exhaust gas reactor for detecting an air-fuel ratio of the mixture out of said reactor;

a source of air;

a secondary air supply pipe communicating said source of air with said exhaust pipe upstream of said exhaust gas reactor for supplying thereinto the air as a secondary air;

a valve member operatively disposed in said secondary air supply pipe for controlling the supply of the secondary air therethrough into said exhaust pipe;

a valve actuator defining therein a pressure chamber and including a deformable diaphragm bordering said pressure chamber and operatively connected to said valve member;

a source of negative pressure;

a negative pressure supply pipe communicating said source of negative pressure with said pressure chamber;

first means disposed in said negative pressure supply pipe for controlling the introduction of the negative pressure into said pressure chamber in accordance with the air-fuel ratio detected by said air-fuel ratio detecting means to thereby actuate said valve member so that the secondary air supply is varied; and second means disposed in said negative pressure supply pipe for periodically rendering said negative pressure supply pipe fluid-conductive and non-conductive irrespective of the detected air-fuel ratio, to thereby smooth the operation of said valve member by said first means.

6. An engine exhaust gas purification system according to claim 5, further comprising third means connected to said second means for actuating the same such that the fluid-conductive duration of said second means is shorter than the fluid-non-conductive duration thereof during a normal engine operation and such that the fluid-conductive duration of said second means is longer than fluid-non-conductive duration thereof during a transition operation of the engine.

* * * * *